US007785159B2

(12) United States Patent
Kumakura

(10) Patent No.: US 7,785,159 B2
(45) Date of Patent: Aug. 31, 2010

(54) FEMALE TERMINAL AND CHAIN TERMINAL THEREOF

(75) Inventor: Hideto Kumakura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/411,560

(22) Filed: Mar. 26, 2009

(65) Prior Publication Data

US 2009/0247001 A1 Oct. 1, 2009

(30) Foreign Application Priority Data

Mar. 28, 2008 (JP) ..... 2008-088496

(51) Int. Cl.
*H01R 11/22* (2006.01)
*H01R 13/11* (2006.01)

(52) U.S. Cl. ..... 439/852; 439/845

(58) Field of Classification Search ..... 439/370, 439/852, 850, 851, 845, 878, 595, 748, 880, 439/867, 849, 866
See application file for complete search history.

(56) References Cited

U.S. PATENT DOCUMENTS

| | | | | |
|---|---|---|---|---|
| 4,950,183 | A | 8/1990 | Watanabe et al. | |
| 5,551,150 | A * | 9/1996 | Zielinski et al. | 29/882 |
| 5,593,328 | A * | 1/1997 | Okada et al. | 439/851 |
| 6,305,992 | B1 | 10/2001 | Bouda et al. | |
| 6,450,843 | B1 * | 9/2002 | Heimuller | 439/852 |
| 6,475,040 | B1 * | 11/2002 | Myer et al. | 439/852 |
| 6,733,346 | B2 * | 5/2004 | Tsuji et al. | 439/748 |
| 7,144,281 | B2 * | 12/2006 | Maeda | 439/852 |
| 7,223,135 | B2 | 5/2007 | Nora et al. | |
| 7,264,518 | B2 * | 9/2007 | Ellis | 439/852 |
| 2001/0003690 | A1 | 6/2001 | Yoshida et al. | |

FOREIGN PATENT DOCUMENTS

| | | | |
|---|---|---|---|
| DE | 69702142 | | 2/2001 |
| JP | 05182711 | A * | 7/1993 |
| JP | 2001-167834 | A | 6/2001 |

OTHER PUBLICATIONS

German Office Action for 10 2009 015 310 received Mar. 11, 2010.

* cited by examiner

*Primary Examiner*—Hae Moon Hyeon
(74) *Attorney, Agent, or Firm*—Sughrue Mion, PLLC

(57) ABSTRACT

A female terminal, includes: a tubular portion which is formed by bending a metal sheet into a tubular shape; a peripheral wall which has a trapezoidal cross section having a pair of opposed shorter and longer sides to form a space extending in an axial direction of the female terminal inside the tubular portion; and a spring portion for pressing a male terminal inserted in the space, in a direction toward the shorter side of the peripheral wall. A maximum width of the male terminal is longer than the shorter side and is shorter than the longer side.

2 Claims, 4 Drawing Sheets

6
2
9
8
4
5
1
3
A

FEMALE TERMINAL AND CHAIN TERMINAL THEREOF

BACKGROUND OF THE INVENTION

1. Technical Field

This invention relates to a female terminal and a chain terminal thereof.

2. Background Art

Among connectors for interconnecting wire harnesses in an automobile, there is known the type of connector in which terminals made of metal are received within a receiving chamber formed in a housing made of a synthetic resin. In such a connector, when a housing having male terminals received therein is fitted to another housing having female terminals received therein, distal end portions (hereinafter referred to as "male tabs") of the male terminals are inserted and received respectively in internal spaces of the female terminals. Thus, the male terminals are electrically connected to the female terminals, respectively.

With respect to the structure of the female terminal into which the male tab is adapted to be inserted, for example, opposite side portions of a thin metal sheet are bent inwardly to form a pair of cantilever-like curled portions of a generally mountain-shaped cross-section (i.e., a generally inverted U-shaped cross-section). The curled portions and a convex bottom surface continuous with these curled portions jointly form a space serving as a receiving portion. The female terminal structure is disclosed in JP-A-2001-167834. In the female terminal, the male tab is inserted into the receiving portion, and is resiliently urged by the pair of curled portions, and is held between the pair of curled portions and the bottom surface, and therefore is retained in the receiving portion.

In recent years, a small-size design of connectors for interconnecting wire harnesses mounted on automobiles or the like has been advanced, and for example, a small-width design of male tabs of male terminals has also been advanced. Under the existing circumstances, however, a small-width design of a receiving portion of a female terminal for receiving the male terminal has been less advanced as compared with the small-width design of the male tab. This is attributable to the fact that in the case of the female terminal, not only the small-width design of the receiving portion must be achieved, but also a required spring (resilient) performance for providing a required retaining (fixing) force for retaining the male tab must be secured. Namely, in order to secure the retaining force for retaining the male tab, a clearance ((the width of the receiving portion)−(the width of the male tab)), formed when inserting the male tab into the receiving portion, must have a predetermined amount regardless of the width of the male tab. And, the clearance rather tends to increase with the decrease of the tab width.

When the clearance, formed upon reception of the male tab in the receiving portion, thus increases, it is feared that the electrical performance of the connector may be affected. For example, the male tab received in the receiving portion is liable to shake because of the formation of the clearance, and therefore the male tab swings or oscillates in a longitudinal direction, and as a result wear due to a sliding movement is promoted, or mating contacts are displaced with respect to each other, so that the electrical connection may be liable to become incomplete.

For example, in the terminal structure of JP-A-2001-167834, the cantilever-like curled portions forming the receiving portion have a large spring constant, and therefore need to be spaced apart in some degree from respective side edges of the male tab in order to suppress the resilient displacement as much as possible. Here, in the case where the clearance between the male tab and each curled portion is decreased, the curled portions tend to become upstanding, so that distal ends of the bent portions thereof can not be pressed into contact with the male tab. Therefore, the terminal structure of JP-A-2001-167834 has a problem that in the case where the terminal is formed into a small-size design, the terminal is liable to shake because of the swinging movement of the male tab.

SUMMARY OF THE INVENTION

It is an object of this invention to provide a female terminal structure in which even when a connector is formed into a small-size design, a swinging movement of a male terminal can be suppressed.

The above object has been achieved by a female terminal of the present invention including a tubular portion which is formed by bending a metal sheet into a tubular shape; a peripheral wall which has a trapezoidal cross section having a pair of opposed shorter and longer sides to form a space extending in an axial direction of the female terminal inside the tubular portion; and a spring portion for pressing a male terminal inserted in the space, in a direction toward the shorter side of the peripheral wall, wherein a maximum width of the male terminal is longer than the shorter side and is shorter than the longer side.

Preferably, the male terminal is fixed to be held by the spring portion and inclined inner side surfaces of the peripheral wall.

In the construction of the invention, the male terminal inserted in the tubular portion is pressed against inclined inner side surfaces of the tubular peripheral wall by the spring portion, so that the male terminal is supported at three points within the space. Therefore, the male terminal can be held in the space without shaking, and a swinging movement of the male terminal can be prevented. In the female terminal, the lengths of the shorter and longer sides are determined according to the maximum width of the male terminal, and merely by doing so, a small-size design of the connector can be easily achieved. Furthermore, the tubular portion is asymmetrical in the upward-downward direction, and therefore a reverse insertion prevention mechanism doe not need to be provided at the terminal, and the production cost can be reduced.

According to another aspect of the invention, there is provided a chain terminal a long strip-like carrier; and a plurality of female terminal pieces which are formed integrally on and extend generally perpendicularly from a side edge of the carrier, and are juxtaposed to one another in a longitudinal direction of the carrier, wherein each of the female terminal pieces is adapted to be formed into the female terminal as defined above.

In the chain terminal including the plurality of female terminal pieces each adapted to be formed into the female terminal of the invention, the tubular portion of the female terminal formed by the female terminal piece has the trapezoidal cross-section. Therefore, the overall length of the periphery of the tubular portion (not yet subjected to a bending operation) in its developed condition (that is, the width of the tubular portion developed in the longitudinal direction of the carrier) is shorter as compared with a usual female terminal in which a tubular portion has a rectangular cross-section. Therefore, a pitch of the juxtaposed female terminal pieces can be reduced, and therefore the amount of the material used for forming the female terminals can be reduced, and the economy can be enhanced.

In the present invention, even when the connector is formed into a small-size design, a swinging movement of the male terminal can be suppressed.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
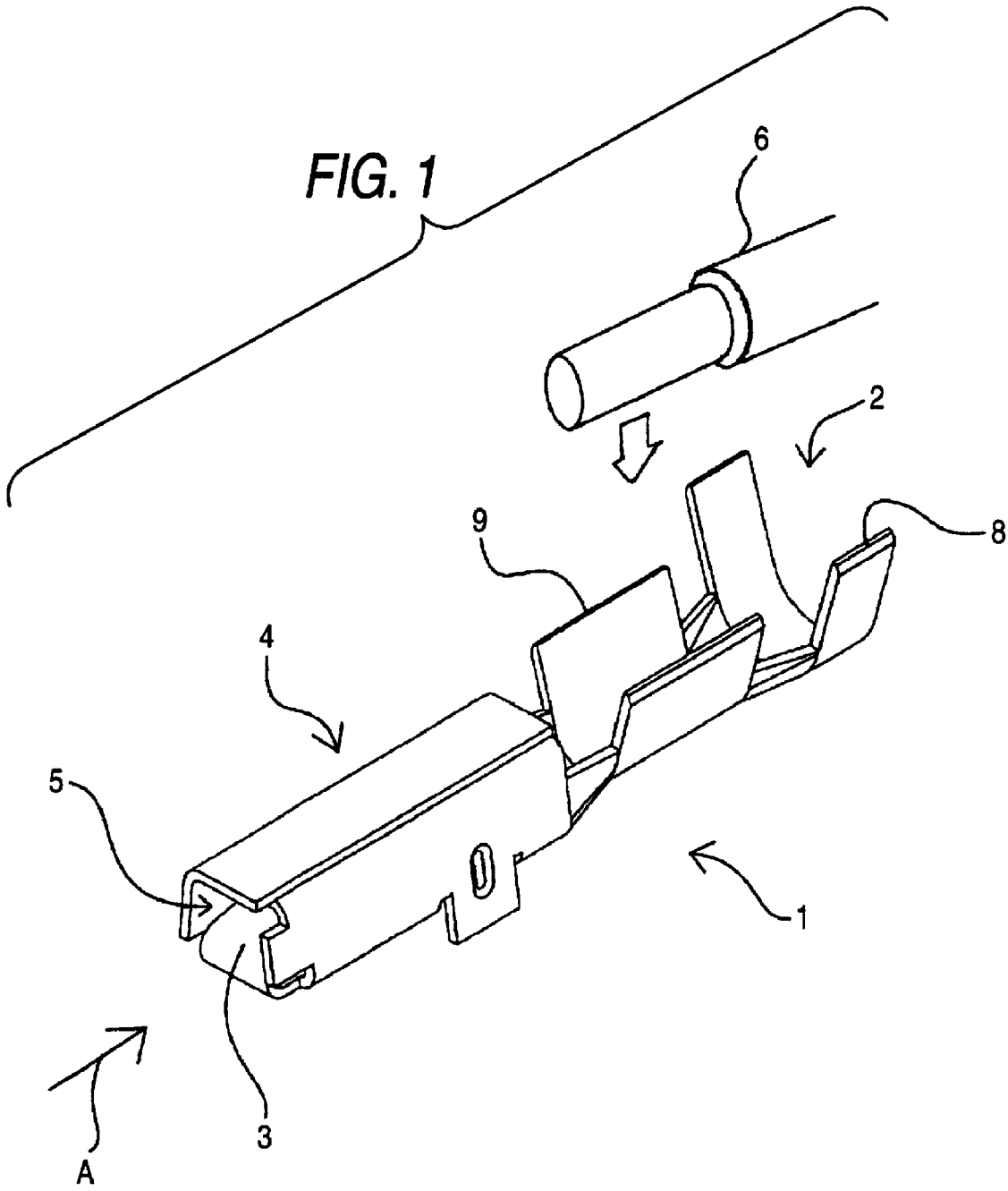
FIG. 1 is a perspective view showing the construction of a female terminal provided in accordance with the present invention.
Figure 2:
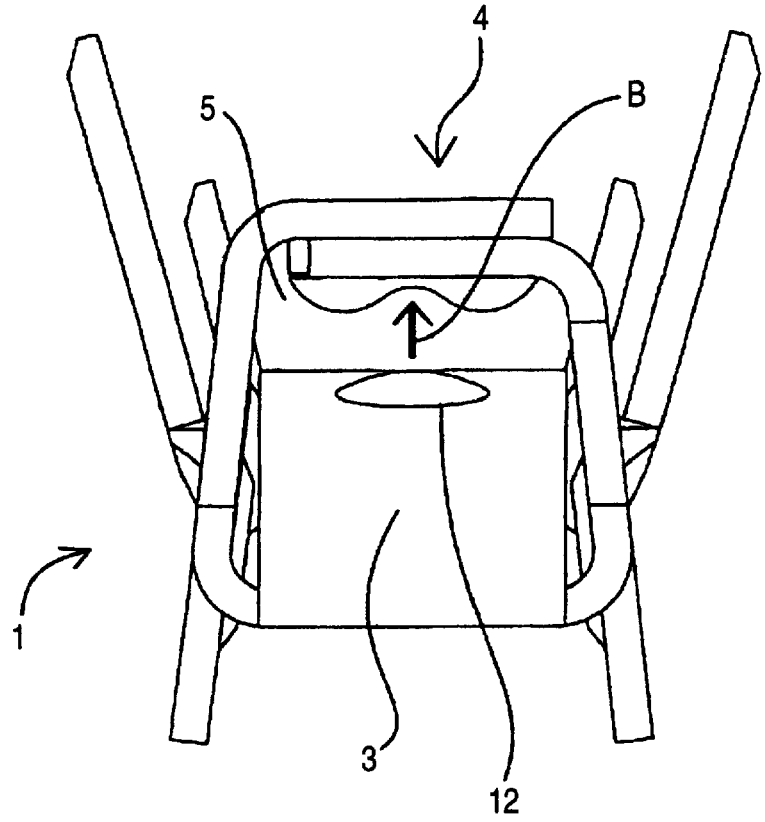
FIG. 2 is a front-elevational view of the female terminal as seen in a direction of arrow A in FIG. 1.
Figure 3:
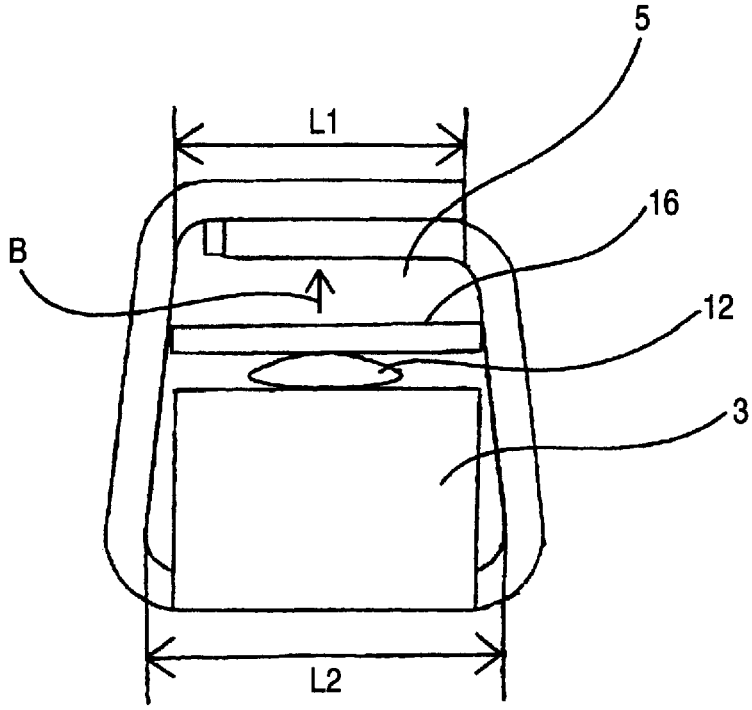
FIG. 3 shows a condition in which a male tab is inserted in the female terminal of FIG. 2.

A preferred embodiment of the present invention will now be described with reference to the drawings. FIG. 1 is a perspective view showing the construction of a female terminal provided in accordance with the invention, FIG. 2 is a front-elevational view of the female terminal as seen in a direction of arrow A in FIG. 1, FIG. 3 shows a condition in which a male tab is inserted in the female terminal of FIG. 2, and FIG. 4 is a plan view showing a female terminal piece in its developed condition.

As shown in the drawings, the female terminal 1 of this embodiment includes a press-clamping portion 2, a spring portion 3, a tubular portion 4, and a space 5. The female terminal 1 is formed by blanking the female terminal piece (shown in its developed condition in FIG. 4) from a metal sheet and then by applying necessary processes (including a bending operation) to the female terminal piece.

Figure 4:
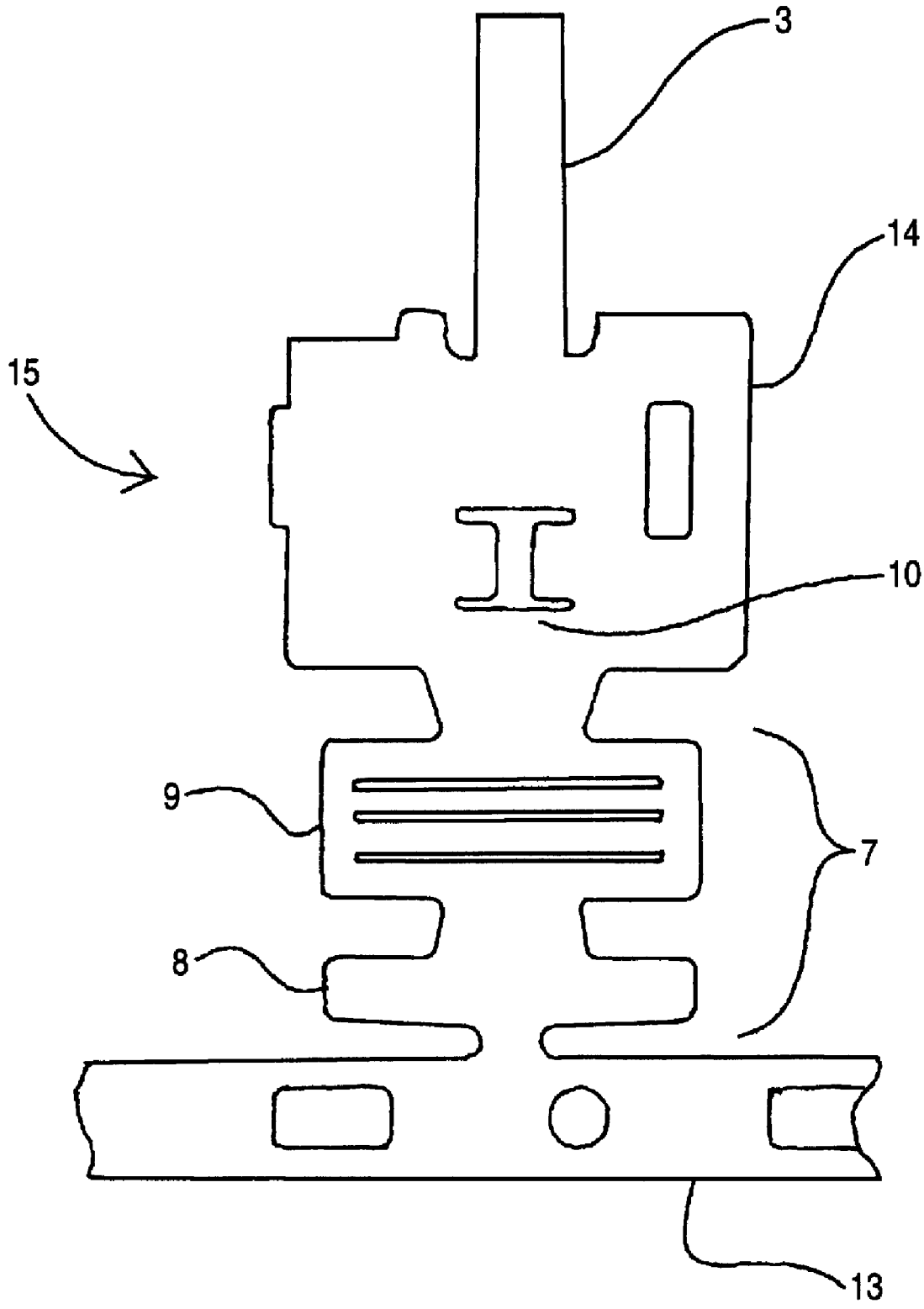
FIG. 4 is a plan view showing the female terminal of FIG. 1 in its developed condition.

The press-clamping portion 2 is adapted to be press-clamped to a wire 6 to be connected thereto, and this press-clamping portion 2 is formed by bending a press-clamping area 7 (see FIG. 4). More specifically, the press-clamping piece area 7 includes a fixing piece portion 8, and a press-clamping piece portion 9. The fixing piece portion 8 is fixed to the wire 6 in embracing relation thereto, and the press-clamping piece portion 9 is press-clamped to the thus fixed wire 6 in embracing relation thereto.

The tubular portion 4 extends from the press-clamping portion 2 in the axial direction of the female terminal 1, and has the space (internal space) 5 extending in the axial direction. A male tab of a mating terminal is adapted to be inserted into the space 5. The spring portion 3 is disposed within the space 5, and has the function of urging the male tab (inserted in the space 5) in a direction intersecting the direction of insertion of the male tab 5, that is, in a direction of arrow B (see FIG. 2).

As shown in FIG. 4, the spring portion 3 is defined by that portion of the female terminal 1 extending axially from the tubular portion 4 in coplanar relation to a base surface 10, and this extension portion is bent or turned back to face the base surface 10, thereby forming the spring portion 3. Therefore, the spring portion 3 can be resiliently deformed or moved, with the turned-back portion serving as a fulcrum. Because of this resilient deformation, the male tab is resiliently urged by the spring portion 3, and is held or retained in the space 5. Further, a contact projection 12 (see FIG. 2), for example, of a generally semi-spherical shape is formed on the spring portion 3, and this contact projection 12 contacts the male tab, thus ensuring the electrical connection.

The tubular portion 4 includes a pair of right and left tubular portion-forming pieces 14 extending respectively from opposite side edges of the base surface (base portion) 10 in a direction perpendicular to the axial direction. The two tubular portion-forming pieces 14 are bent to cover the spring portion 3, with a suitable holding clearance formed between the spring portion 3 and these tubular portion-forming pieces 14, such that upper portions (FIG. 2) of the two tubular portion-forming pieces 14 are superposed together (that is, one side (face) of one of the two tubular portion-forming pieces 14 is superposed on one side (face) of the other).

As shown in FIG. 4, each female terminal piece 15, before undergoing the bending operation, is formed integrally on a side edge of a long strip-like carrier 13 such that the press-clamping portion-forming portion 7 is continuous at its one end with the carrier 13. In FIG. 4, although one female terminal piece 15 not yet subjected to the bending operation is formed integrally on the carrier 13, a plurality of parallel female terminal pieces 15 are actually formed on and extend substantially perpendicularly from the side edge of the carrier 13, and are juxtaposed to one another in a longitudinal direction of the carrier 13. The plurality of female terminal pieces 15 are arranged at a predetermined pitch such that any two adjacent female terminal pieces 15 are spaced a predetermined distance from each other.

Next, the construction of the tubular portion 4 will be described in further detail.

The pair of tubular portion-forming pieces 14 of the tubular portion 4 are bent such that the resultant tubular portion 4, when viewed in the direction of arrow A, has a trapezoidal shape as shown in FIG. 2. Thus, the space 5 formed by bending the pair of tubular portion-forming pieces 14 has a trapezoidal cross-section, and extends in the axial direction. Here, when the side toward which the arrow B is directed is defined as the upper side, an upper side of the cross-section of the space 5 is shorter while a lower side thereof is longer. Therefore, the pair of tubular portion-forming pieces 14, extending upwardly from the base surface 10, are superposed together at their upper portions, and these superposed portions serve as the shorter side, and the base surface 10 opposed to the shorter side serves as the longer side.

Next, effects obtained when inserting the male tab into the female terminal 1 of the above construction will be described. As shown in FIG. 3, the male tab 16 has a rectangular cross-section whose widthwise direction (which is perpendicular both to the inserting direction (male tab-inserting direction) and the direction of arrow B) is a longitudinal direction. When the male tab 16 is inserted into the space 5, the spring portion 3 is pressed down into a resiliently-deformed condition, so that a resilient force of the spring portion 3 acts on the male tab 16 to urge the same upwardly. Therefore, opposite side edges of the upper surface of the male tab 16 are pressed respectively against inclined inner surfaces of the two tubular portion-forming pieces 14. Thus, the male tab 16 is supported at three points by the contact projection 12 and the inclined inner surfaces of the two tubular portion-forming pieces 14.

Here, in order that the male tab 16 can be supported within the space 5, it is necessary that the maximum dimension (that is, the dimension in the widthwise direction in FIG. 3) of the male tab 16 should be longer than the shorter side L1 and also should be shorter than the longer side L2. Namely, the lengths of the longer and shorter sides L2 and L1 of the tubular portion 4 of the female terminal 1 need to be determined on the basis of the maximum width of the male tab 16 to be inserted into the space 5.

As described above, in this embodiment, the male tab 16 is pressed against the inclined inner surfaces of the right and left tubular portion-forming pieces 14 by the spring portion 3, and therefore the male tab 16 can be held within the space 5 without shaking. Therefore, a swinging movement of the male tab 16 can be suppressed, and therefore wear due to a sliding movement between the mating (female and male) terminals can be suppressed, and also incomplete electrical connection due to the displacement of the mating contacts with respect to each other can be suppressed.

Furthermore, in the female terminal 1 of this embodiment, the tubular portion-forming pieces 14 are bent to form the space 5 of the trapezoidal cross-section having the longer side of a predetermined length and the shorter side of a predetermined length, and merely by doing so, a small-size design of the connector can be easily achieved.

In addition, the tubular portion 4 is asymmetrical in the direction of arrow B (that is, in the upward-downward direction), and therefore a reverse insertion prevention mechanism such as a stabilizer doe not need to be provided at the terminal. Therefore, the shape of the terminal, as well as the structure of a die for forming the terminal, is prevented from becoming complicated, and therefore the production cost can be reduced.

Figure 5:
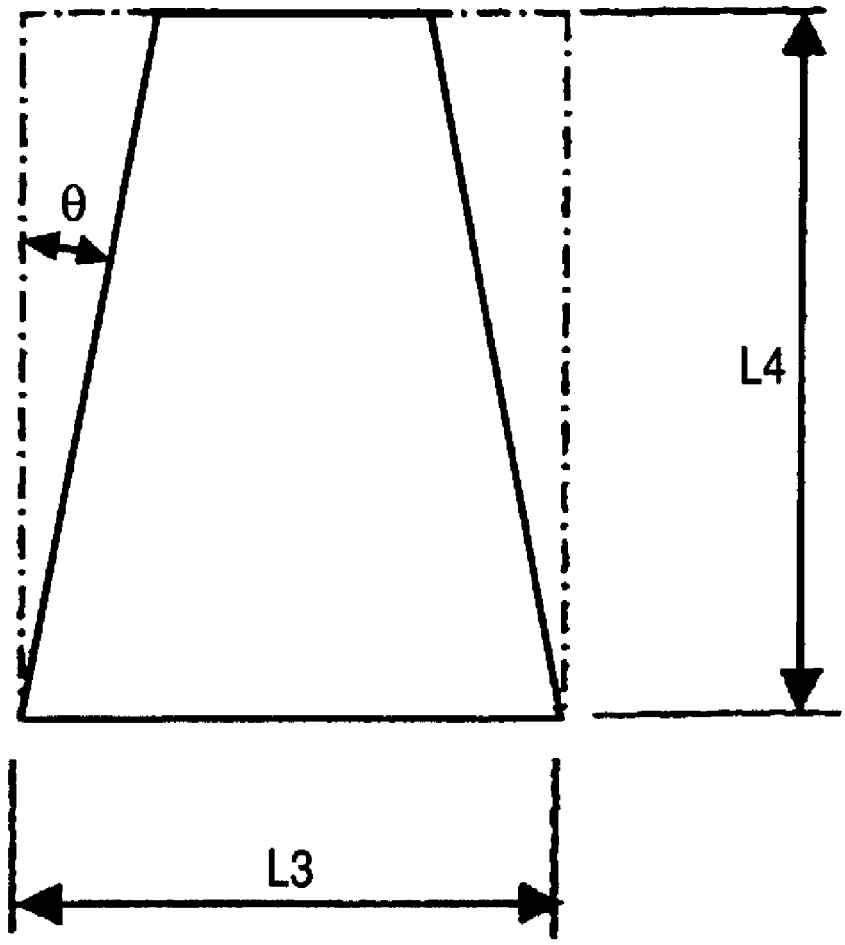
FIG. 5 is a view explanatory of an overall peripheral length of a space formed in the female terminal of the invention.

Furthermore, the space 5 in the female terminal 1 has the trapezoidal cross-section, and therefore the width dimension of the female terminal piece 15 in its developed condition, that is, the width of the female terminal piece 15 in the longitudinal direction of the carrier 13, can be reduced as shown in FIG. 4. In a case where the space 5 has a rectangular cross-section as shown in FIG. 5, the overall length of an inner peripheral surface of the tubular portion forming the space 5 is (L3+L3)+2×L4). On the other hand, when the space 5 has the trapezoidal cross-section as in this embodiment, the overall length of the inner peripheral surface of the tubular portion 4 is ((L3+L3)−2×L4 tan θ)+2×(L4/cos θ)), and in this case it is clear that the overall length of the inner peripheral surface is shorter as compared with the case where the space 5 has the rectangular cross-section. Of course, even in a case where the cross-section of the space 5 is formed in a non-isosceles trapezoid, the overall length of the inner peripheral surface can be short.

By thus reducing the width of the female terminal piece 15 in its developed condition, the pitch of the juxtaposed female terminal pieces 15 can be reduced, and therefore the amount of the material used for forming the female terminals can be reduced.

What is claimed is:

1. A female terminal, comprising:

a tubular portion which is formed by bending a metal sheet into a tubular shape;

a peripheral wall which has a trapezoidal cross section having a pair of opposed shorter and longer sides and opposed inclined sides extended between the shorter and longer sides to form a space extending in an axial direction of the female terminal inside the tubular portion; and a spring portion for pressing a male terminal inserted in the space, in a direction toward the shorter side of the peripheral wall against inner surfaces of the opposed inclined sides, thereby three-point supporting the male terminal by the spring portion and the inner surfaces of the opposed inclined sides, wherein a maximum width of the male terminal is longer than the shorter side and is shorter than the longer side.

2. A chain terminal, comprising:

a long strip-like carrier; and a plurality of female terminal pieces which are formed integrally on and extend generally perpendicularly from a side edge of the carrier, and are juxtaposed to one another in a longitudinal direction of the carrier, wherein each of the female terminal pieces is adapted to be formed into the female terminal as defined in claim 1.

* * * * *